US005960696A

United States Patent [19]

Niwa et al.

[11] Patent Number: 5,960,696

[45] Date of Patent: Oct. 5, 1999

[54] HYDRAULIC CYLINDER WITH PRESS-FITTED PIPE

[75] Inventors: Susumu Niwa; Mineo Tanahashi, both of Kani, Japan

[73] Assignee: Kayaba Kogyo Kabushiki Kaisha, Tokyo, Japan

[21] Appl. No.: 08/953,391

[22] Filed: Oct. 17, 1997

[30] Foreign Application Priority Data

Oct. 21, 1996 [JP] Japan ..... 8-297827

[51] Int. Cl.[6] ..... F15B 15/22; F01B 11/02

[52] U.S. Cl. ..... 92/8; 92/85 B; 92/82; 92/142; 92/143; 91/27; 91/31

[58] Field of Search ..... 91/6, 19, 22, 26, 91/27, 31, 407, 408, 409, 396; 92/8, 9, 10, 81, 82, 85 R, 85 B, 109, 110, 111, 112, 142, 143

[56] References Cited

U.S. PATENT DOCUMENTS

| | | | |
|---|---|---|---|
| 2,974,636 | 3/1961 | Farmer | 92/109 X |
| 3,232,180 | 2/1966 | Deschenes | 92/82 X |
| 3,257,912 | 6/1966 | Vander Horst | 92/110 X |
| 3,259,026 | 7/1966 | Madland et al. | 91/126 |
| 3,835,753 | 9/1974 | Bunyard | 91/126 X |
| 5,193,433 | 3/1993 | Reimer | 92/85 B |
| 5,314,172 | 5/1994 | Wallis | 92/110 X |

FOREIGN PATENT DOCUMENTS

| | | | |
|---|---|---|---|
| 194894 | 3/1965 | Sweden | 92/111 |

*Primary Examiner*—John E. Ryznic
*Attorney, Agent, or Firm*—McGlew & Tuttle, P.C.

[57] ABSTRACT

It is intended to dispense with the pipe welding work, thereby improve the pipe mounting performance and prevent contamination which results from welding, and elimination the waste of oil.

A spigot portion 34 is mounted upright integrally in the center of the upper end portion of a piston 17, the base end of a piston rod 18 is fitted on the outer periphery of the spigot portion 34, and the outer periphery of the base end of a pipe 41 is press-fitted into an upper hollow part of the spigot portion 34.

13 Claims, 4 Drawing Sheets

HYDRAULIC CYLINDER WITH PRESS-FITTED PIPE

FIELD OF THE INVENTION

The present invention relates to a hydraulic cylinder attached to, for example, a fork lift for raising and lowering goods.

BACKGROUND OF THE INVENTION

As this type of a hydraulic cylinder there is known, for example, such a hydraulic cylinder as shown in FIG. 4, in which a bottom 2 and a cap 3 are provided at both end portions of a cylinder 1, a piston 4 is inserted movably into the cylinder 1, a hollow piston rod 5 is also inserted movably into the cylinder 1 through the cap 3, the piston 4 defines a rod-side oil chamber 6 and a piston-side oil chamber 7 within the cylinder 1, the rod-side oil chamber 6 being in communication with a reservoir 9 in the piston rod 5 through an oil hole 8 formed in the lower portion of the piston rod 5, a pipe 10 extending into the reservoir 9 is mounted upright on the upper end portion of the piston 4, a check valve 12 for opening and closing the reservoir 9 and the piston-side oil chamber 7 is disposed in a through hole 11 formed in the piston 4, and the piston-side oil chamber 7 communicates selectively with a pump or a tank through an oil passage 13.

In the above hydraulic cylinder, a recess 14 is formed in the upper end of the piston 4, the lower end of the piston rod 5 is threadedly engaged with the inner periphery of the recess 14, and within the recess 14 the lower end of the pipe 10 is welded centrally to the upper end of the piston 4.

Although the above conventional hydraulic cylinder does not involve any special problem in point of function, there are the following inconveniences.

① Firstly, since the pipe is welded within the recess groove, the working efficiency of welding is low and it is difficult to remove spatter and scale resulting from welding. Residual spatter and scale may give rise to a serious trouble.

② Secondly, the oil present in the rod-side oil chamber 6 and that in the reservoir 9 flow out through the oil hole 8 which is throttled gradually with the cap 3 during extension of the piston rod, to exhibit a cushioning effect. However, since the base end of the piston rod 5 is fitted in the recess 14, the oil incapable of being used for the cushioning effect stays in a dead space A formed between the outer periphery of the lower end of the pipe 10 and the inner periphery of the lower end of the piston rod 5, with the result that oil comes to nothing. In the above conventional hydraulic cylinder, moreover, since the cushioning effect is not exhibited in the vicinity of the most compressed state, it is possible that there will occur a sudden shock at the time of compression and the resulting fall of goods.

SUMMARY OF THE INVENTION

It is a primary object of the present invention to provide another hydraulic cylinder suitable for use in a fork lift or the like and capable of dispensing with the pipe welding work to improve the pipe mounting performance and prevent contamination caused by welding, and free from waste of oil.

It is the second object of the present invention to provide another hydraulic cylinder capable of exhibiting a cushioning effect also during compression.

In order to achieve the above primary object, in a hydraulic cylinder wherein a bottom is provided at one end of a cylinder, a cap is provided at the opposite end of the cylinder, a hollow piston is inserted movably into the cylinder, a piston rod is also inserted movably into the cylinder through the cap, the piston defines a rod-side oil chamber and a piston-side oil chamber within the cylinder, the rod-side oil chamber communicating with a reservoir in the piston rod through an oil hole formed in the lower portion of the piston rod, a pipe extending into the reservoir is mounted upright on the upper end portion of the piston, a relief valve for opening and closing the reservoir and the piston-side oil chamber is disposed in the hollow portion of the piston, and the piston-side oil chamber communicates selectively with a pump or a tank, the construction of the present invention is characteristic in that a spigot portion is mounted upright integrally in the center of the upper end portion of the piston, the base end of the piston rod is fitted on the outer periphery of the spigot portion, and the outer periphery of the base end of the pipe is press-fitted into an upper part of the hollow portion of the spigot portion.

In order to achieve the above second object, in a hydraulic cylinder wherein a bottom is provided at one end of a cylinder, a cap is provided at the opposite end of the cylinder, a hollow piston is inserted movably into the cylinder, a piston rod is also inserted movably into the cylinder through the cap, the piston defines a rod-side oil chamber and a piston-side oil chamber within the cylinder, the rod-side oil chamber communicating with a reservoir in the piston rod through an oil hole formed in the lower portion of the piston rod, a pipe extending into the reservoir is mounted upright on the upper end portion of the piston, a relief valve for opening and closing the reservoir and the piston-side oil chamber is disposed in holllow portion of the piston, and the piston-side oil chamber communicates selectively with a pump or a tank, the construction of the present invention is characteristic in that a spigot portion is mounted upright integrally in the center of the upper end portion of the piston, the base end of the piston rod is fitted on the outer periphery of the spigot portion, the outer periphery of the base end of the pipe is press-fitted into an upper part of the hollow portion of the spigot portion, a hollow oil bore rod is mounted upright integrally in the center of the upper end of the bottom, and a cushion ring is provided on the inner periphery of the lower hollow portion of the piston so as to be fitted on the outer periphery of the oil bore rod.

Preferably, a snap ring is interposed between the outer periphery of the spigot portion and the inner periphery of the base end of the piston rod, the outer periphery of the upper end of the spigot portion is tapered in a conical shape, and another oil path which provides communication between the rod-side oil chamber and the reservoir are formed in the vicinity of the lower end portion of the piston rod and in the spigot portion.

The relief valve may be disposed at a lower position of the hollow portion of the piston or within the hollow portion of the spigot portion. Preferably, the cushion ring serves also as a check valve for opening and closing the piston-side oil chamber and the hollow portion of the piston.

DESCRIPTION OF THE PREFERRED EMBODIMENTS

The present invention will be described below by way of embodiments thereof with reference to the accompanying drawings.

Figure 1:
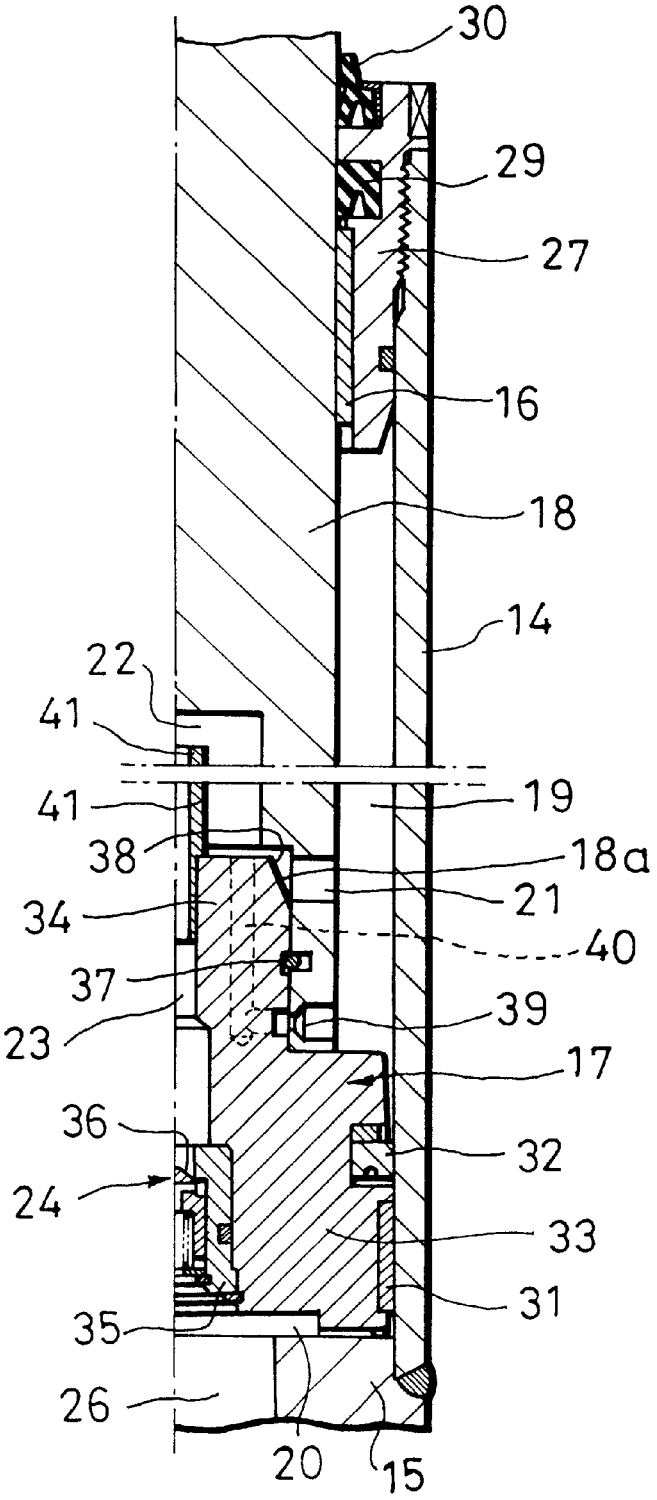
FIG. 1 is a partially enlarged front view in vertical section of a hydraulic cylinder according to an embodiment of the present invention.
Figure 2:
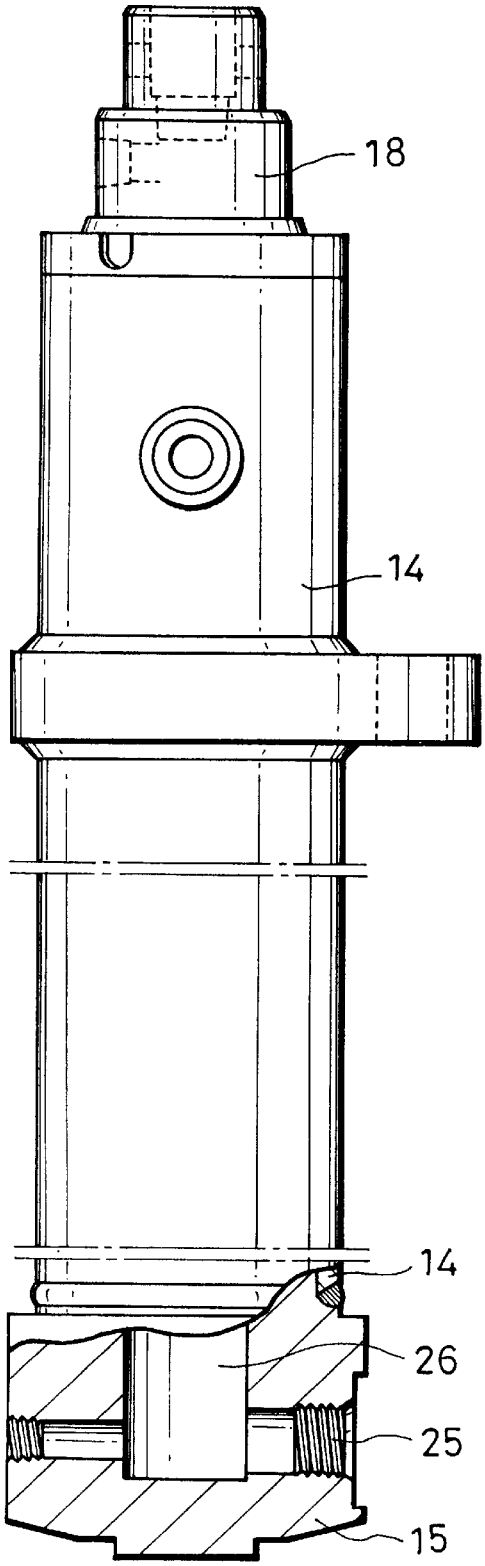
FIG. 2 is a partially cut-away front view of the hydraulic cylinder.

FIGS. 1 and 2 illustrate a hydraulic cylinder according to an embodiment of the present invention. In this hydraulic cylinder, as in the conventional hydraulic cylinder, a bottom 15 is provided at one end of a cylinder 14 and a cap 27 is provided at the opposite end of the cylinder. Into the cylinder 14 is inserted a piston 17 movably and also inserted a piston rod 18 movably through a bearing 16 disposed within the cap 27. The piston 17 defines a rod-side oil chamber 19 and a piston-side oil chamber 20 within the cylinder 14. Through an oil hole 21 formed in the lower portion of the piston rod 18 the rod-side oil chamber 19 is in communication with a reservoir 22 formed within the piston rod 18. Within a central passage 23 of the piston 17 is disposed a relief valve 24 which can open and close to open and close the reservoir 22 and the piston-side oil chamber 20. Further, the piston-side oil chamber 20 is brought into communication selectively with a pump or a tank through an external change-over valve and through oil paths 25 and 26 formed in the bottom 15.

The cap 27 is connected to the upper end portion of the cylinder 14 through threads and seal. In the inner periphery of the cap 27 are provided the bearing 16, an oil seal 29 and a dust seal 30 to guide the piston rod 18.

Through a bearing 31 and a seal 32 both formed in the outer periphery of the piston 17, the piston slides on the inner periphery of the cylinder 14.

The piston 17 comprises a piston body 33. A spigot portion 34 is mounted upright integrally in the center of the upper end of the piston body 33. An axial hollow portion is formed as the oil passage 23 centrally of both piston body 33 and spigot portion 34.

A hollow valve housing 35 is fixed to the lower hollow portion of the piston 17, that is, to the inner periphery of the piston body 33, through a seal and retaining means. The valve housing 35 is formed with a stepped portion on the upper portion of its inner periphery side. Into the valve housing 35 is inserted the relief valve 24 which comprises a valve body 36 and a spring for urging the valve body 36 toward the said stepped portion side. In the event the amount of oil in the rod-side oil chamber 19 increases due to oil leakage from the seal 32 for example, and if the piston rod 18 extends in this state, the internal pressure of the rod-side oil chamber 19 rises with the resulting contraction of the same chamber, which may cause an abnormal increase in the internal pressure of the rod-side oil chamber 19 and the reservoir 22. This increased internal pressure causes the valve body 36 to open against the biasing force of the spring, allowing the pressure in the reservoir 22 to escape into the piston-side oil chamber 20.

For defining the reservoir 22 which comprises an oil chamber and a gas chamber in the lower portion of the piston rod 18, the lower portion of the piston rod is formed in a cylindrical shape, and the inner periphery of the lower, cylindrical base end portion of the piston rod is fitted on the outer periphery of the spigot portion 34.

Opposed grooves are formed between the outer periphery of the spigot portion 34 and a base-end recess 18*a* of the piston rod 18 which defines the reservoir 22, and a snap ring 37 or any other retaining means is fitted in the said grooves to fix the base end of the piston rod 18 to the spigot portion 34.

The outer periphery of the upper end of the spigot portion 34 is conically tapered as indicated at 38. For fitting the snap ring 37 in the aforesaid groove, the snap ring 37 is fitted beforehand in the groove of the piston rod 18 and then the base end of the piston rod 18 is fitted forcibly downward onto the spigot portion 34, whereby the snap ring 37 is guided by the taper 38 and can be brought into engagement into the groove formed in the outer periphery of the spigot portion 34 while expanding its diameter smoothly.

Also in the lowest end portion of the piston rod 18 is formed a throttle hole 39, which is in communication with an oil path 40 formed in the spigot portion 34. The lower portion of the rod-side oil chamber 19 is in communication with the reservoir 22 through the throttle hole 39 and the oil path 40.

The upper oil hole 21 formed in the piston rod 18 provides communication between the rod-side oil chamber 19 and the reservoir 22. Besides, when the oil hole 21 is closed by the bearing 16 with extension of the piston rod, the oil hole 21 brings about a throttling effect for the flow from the rod-side oil chamber 19 to the reservoir 22. The throttle hole 39 causes the oil in the rod-side oil chamber 19 to flow out into the reservoir 22 while throttling it even when the oil hole 21 is closed with the bearing 16, thereby permitting the piston 17 to move up to its fully extended state in which the piston is in abutment with the cap 27.

A pipe 41 is fitted upright in the upper end portion of the inner periphery of the spigot portion 34. By the height of the pipe 41, the amount of oil in the rod-side oil chamber 19 necessary for cushioning is controlled, in other words, the oil level is controlled to above the upper end of the oil hole 21.

The lower portion of the pipe 41 is press-fitted into the hollow portion of the spigot portion 34 along the inner periphery of the spigot portion until a stepped portion formed on the outer periphery of the pipe 41 is retained by the upper end of the spigot portion 34.

The center of the pipe 41 provides communication between the reservoir 22 and the oil passage 23.

For example, the above-mentioned hydraulic cylinder constructed as above is attached to a fork lift to raise and lower goods. In this case, when a high-pressure oil is fed to the piston-side oil chamber 20, both piston 17 and piston rod 18 rise, so that goods supported by an outer end of the piston rod 18 move upward.

In the vicinity of the maximum extension, the upper oil hole 21 is throttled gradually by the bearing 16 and the oil in the rod-side oil chamber 19 flows out into the reservoir 22 through the throttled oil path, so that cushioning takes effect gradually.

Although the upper oil hole 21 closed at the maximum extension of the piston rod, the piston 17 can extend up to its abutment with the cap 27 because the lower throttle hole 39 is open.

For lowering the goods or for bringing down the piston rod 18 alone from the extended state, the piston-side oil chamber 20 is connected to a tank through a change-over valve. In this case, the goods or the piston rod 18 descends to its most compressed position due to its own weight.

In the hydraulic cylinder described above, since the spigot portion is mounted upright on the piston and the base end of the piston rod is fitted on the spigot portion, there is not formed any dead space between the spigot portion and the piston rod, so that there is no staying of any unnecessary oil and hence oil can be utilized effectively.

Besides, since the pipe 41 is press-fitted into the spigot portion 34, the welding work is not needed and the working efficiency for mounting the pipe is improved. Further, since welding is not required, there is no fear of spatter, etc. being mixed in the oil.

Figure 3:
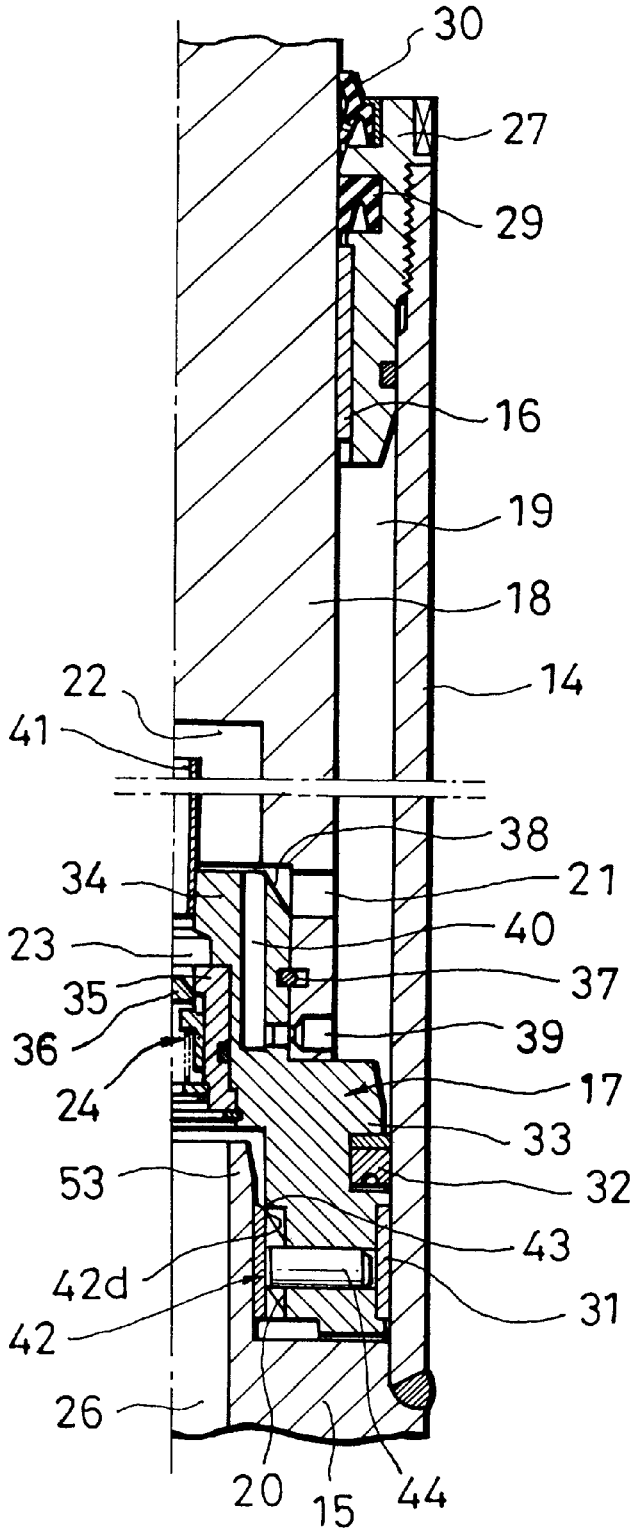
FIG. 3 is a partially enlarged front view in vertical section of a hydraulic cylinder according to another embodiment of the present invention.
Figure 4:
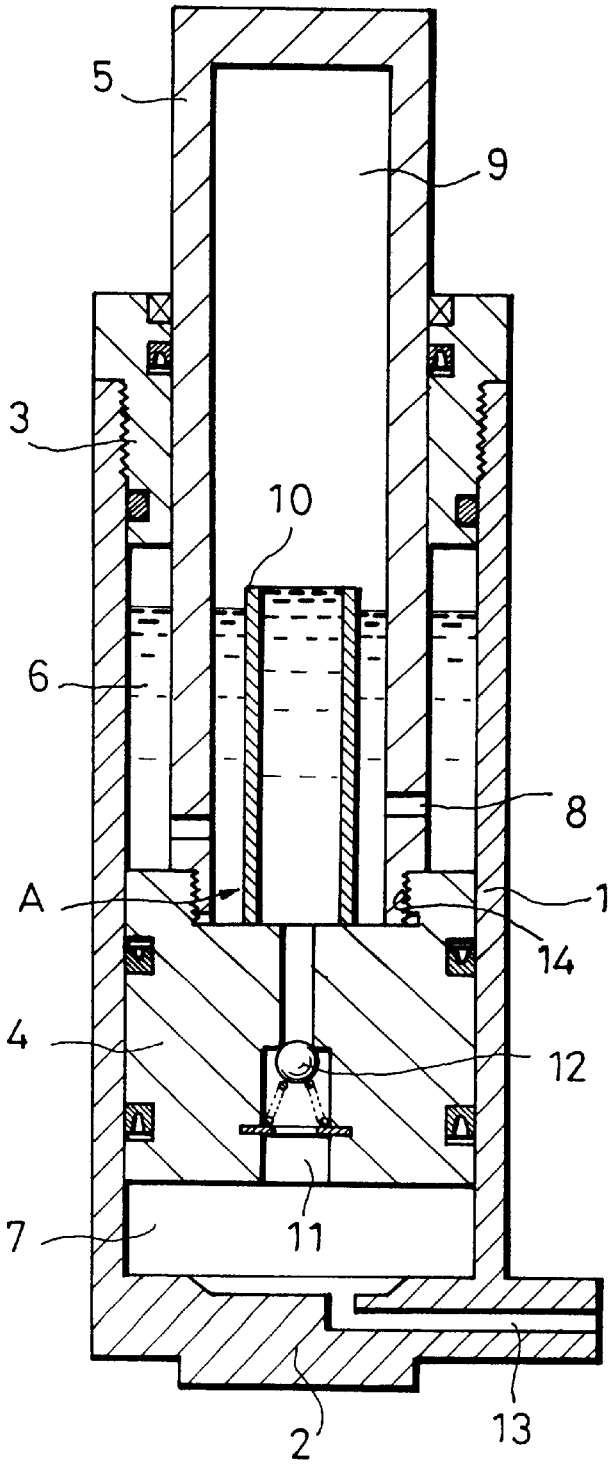
Fig. 4 PRIOR ART
FIG. 4 is a front view in vertical section of a conventional hydraulic cylinder.

FIG. 3 illustrates a hydraulic cylinder according to another embodiment of the present invention. In this hydraulic cylinder, a cushion ring 42 is provided in the lower inner periphery portion of a piston 17, an oil bore rod 53 is mounted upright in the upper end of a bottom 15, and a relief valve 24 is disposed on the inner periphery side of the spigot portion 34, allowing a cushioning effect to be exhibited during compression by means of both cushion ring 42 and oil bore rod 53. The other points relating to structure, function and effect are the same as in the hydraulic cylinder of the previous embodiment illustrated in FIG. 1. Therefore, the same structural portions are indicated by the same reference numerals as in FIG. 1 and detailed explanations thereof are here omitted.

The piston 17 comprises a piston body 33. A hollow spigot portion 34 is mounted upright in the center of the upper end of the piston body 33, and a valve housing 35 is fitted in the spigot portion 34 along the inner periphery of the spigot portion 34. Into the valve housing 35 is inserted the relief valve 24 in a vertically movable manner to open and close an oil passage 23 as in the embodiment illustrated in FIG. 1.

In a lower large-diameter portion of the hollow portion of the piston body 33 is disposed the cushion ring 42 which is cylindrical and movable axially thereof. The cushion ring 42 is movable into abutment with and away from a stepped upper end portion 43 of the said large-diameter portion. A cut-out 42*d* is formed axially in the outer periphery of the cushion ring 42. As the cushion ring 42 moves downward in the figure, a passage 26 is brought in communication with a piston-side oil chamber 20 through the cut-out 42*d*. On the other hand, as the cushion ring 42 moves upward in the figure and comes into abutment with the stepped portion 43, the communication of the passage 26 with the piston-side oil chamber 20 through the cut-out 42*d* is cut off and there remains communication only through an annular clearance between the cushion ring 42 and the oil bore rod 53.

The cushion ring 42 has an annular groove formed in the outer periphery thereof. A support rod 44 is inserted sideways into the piston body 33 and the front end thereof is engaged with the said annular groove, whereby the cushion ring is supported vertically movably.

The cylindrical oil bore rod 53 is mounted upright in the center of the upper end of the bottom 15, and in the vicinity of the most compressed state the cushion ring 42 is fitted on the outer periphery of the oil bore rod 53. More specifically, when a high-pressure oil is introduced into the oil passage 26, the high-pressure oil pushes open the cushion ring 42 downward and is introduced into the piston-side oil chamber 20 through the clearance between the cushion ring and the stepped portion 43 and through the cut-out 42*d*, whereby the piston 17 and the piston rod 18 are extended in the same manner as in FIG. 1. On the other hand, during compression, the piston 17 descends due to its own weight or both its own weight and the thickness of goods, and in the vicinity of the most compressed state, the cushion ring 42 is fitted on the outer periphery of the oil bore rod 53. At this time, the cushion ring 42 is in abutment with the stepped portion 43 and is closed because it is pushed upward by virtue of the internal pressure of the piston-side oil chamber 20, so that the oil in the piston-side oil chamber 20 flows out to the oil passage 26 side through the clearance between the outer periphery of the oil bore rod 53 and the inner periphery of the cushion ring 42. The resulting flow resistance affords a cushioning effect.

According to the present invention there are attained the following effects.

① Since a spigot portion is mounted upright in the center of the upper end of the piston and the base end of the piston rod is fitted on the spigot portion, an annular space is not formed between the outer periphery of the spigot portion and the inner periphery of the base end of the piston rod, so that there is no fear of remaining of unnecessary oil. That is, the whole quantity of oil can be utilized effectively.

② Since a pipe is press-fitted upright into the upper inner periphery portion of the spigot portion, the pipe mounting work is improved and welding is not needed. Consequently, it is possible to eliminate the inconvenience that there remains contamination which results from welding.

③ Since a cushion ring which serves also as a check valve is disposed in the lower inner periphery portion of the piston and an oil bore rod is provided centrally of the upper end of the bottom, a cushioning effect is exhibited in the vicinity of the most compressed state to absorb an abrupt shock, whereby it is made possible to prevent damage of the hydraulic cylinder itself and prevent goods from falling while the fork lift is in use.

④ Even if a cushion ring is provided in the lower inner periphery portion of the piston, this does not lead to the substantial decrease in effective stroke of the hydraulic cylinder because a relief valve is disposed within the spigot portion.

What is claimed is:

1. In a hydraulic cylinder wherein a bottom is provided at one end of a cylinder, a cap is provided at the opposite end of the cylinder, a hollow piston is inserted movably into the cylinder, a piston rod is also inserted movably into the cylinder through said cap, said piston defines a rod-side oil chamber and a piston-side oil chamber within the cylinder, said rod-side oil chamber communicating with a reservoir in said piston rod through an oil hole formed in the lower portion of the piston rod, a pipe extending into said reservoir is mounted upright on the upper end portion of the piston, a relief valve for opening and closing said reservoir and said piston-side oil chamber communicates selectively with a pump or a tank, the improvement characterized in that a spigot portion is mounted upright integrally in the center of the upper end portion of the piston, the base end of said piston rod is fitted on the outer periphery of said spigot portion, and the outer periphery of the base end of said pipe is press-fitted into an upper part of the hollow portion of the spigot portion.

2. A hydraulic cylinder according to claim 1, wherein a snap ring is interposed between the outer periphery of said spigot portion and the inner periphery of the base end of said piston rod, the outer periphery of the upper end of said spigot portion is tapered in a conical shape, and another oil path which provides communication between said rod-side oil chamber and said reservoir are formed in vicinity of the lower end portion of the piston rod and in the spigot portion.

3. A hydraulic cylinder according to claim 2, wherein said relief valve is disposed at a lower position of the hollow portion of said piston.

4. A hydraulic cylinder according to claim 2, wherein said relief valve is disposed within the hollow portion of said spigot portion.

5. A hydraulic cylinder according to claim 2, wherein said cushion ring serves also as a check valve for opening and closing both said piston-side oil chamber and the hollow portion of said piston.

6. A hydraulic cylinder according to claim 1, wherein said relief valve is disposed at a lower position of the hollow portion of said piston.

7. In a hydraulic cylinder wherein a bottom is provided at one end of a cylinder, a cap is provided at the opposite end of the cylinder, a hollow piston is inserted movably into the cylinder, a piston rod is also inserted movably into the cylinder through said cap, said piston defines a rod-side oil chamber and a piston-side oil chamber within the cylinder, said rod-side oil chamber communicating with a reservoir in said piston rod through an oil hole formed in the lower portion of the piston rod, a pipe extending into said reservoir is mounted upright on the upper end portion of the piston, a relief valve for opening and closing said reservoir and said piston-side oil chamber is disposed in the hollow portion of the piston, and said piston- side oil chamber communicates selectively with a pump or a tank, the improvement characterized in that a spigot portion is mounted upright integrally in the center of the upper end portion of the piston, the base end of the piston rod is fitted on the outer periphery of said spigot portion, the outer periphery of the base end of said pipe is press-fitted into an upper part of the hollow portion of said spigot portion, a hollow oil bore rod is mounted upright integrally in the center of the upper end of said bottom, and a cushion ring is provided on the inner periphery of the lower hollow portion of the piston so as to be fitted on the outer periphery of said oil bore rod, said cushion ring defines an axial cut-out formed on an outer periphery of the cushion ring, said cushion ring is mounted axially movable in said hollow portion of said piston, said cushion ring has a cushion effect and a check valve function.

8. A hydraulic cylinder according to claim 7, wherein said relief valve is disposed within the hollow portion of said spigot portion.

9. A hydraulic cylinder according to claim 7, wherein said cushion ring serves also as a check valve for opening and closing both said piston-side oil chamber and the hollow portion of said piston.

10. A hydraulic cylinder according to claim 7, wherein a snap ring is interposed between the outer periphery of said spigot portion and the inner periphery of the base end of said piston rod, the outer periphery of the upper end of said spigot portion is tapered in a conical shape, and another oil path which provides communication between said rod-side oil chamber and said reservoir are formed in vicinity of the lower end portion of the piston rod and in the spigot portion.

11. A hydraulic cylinder comprising:

a cylinder having ends;

a bottom arranged at one said end of said cylinder;

a cap arranged at another said end of said cylinder;

a piston arranged movably in said cylinder, said piston dividing an area in said cylinder into a rod side chamber and a piston side chamber, said piston defining a hollow portion;

a piston rod arranged movably in said cylinder and through said cap, said piston rod defines a reservoir and an oil hole, said rod-side chamber communicating with said reservoir in said piston rod through said oil hole;

a spigot mounted integrally in, and extending from, a center of a rod side of the piston, said spigot defining a hollow portion, said hollow portions of said piston and said spigot communicating said reservoir and said piston side chamber, said piston rod being press-fitted onto an outer periphery of said spigot;

a relief valve in said piston and for opening and closing communication through said hollow portions of said piston and said spigot;

a pipe press fitted into said hollow portion of said spigot and extending from said piston into said reservoir.

12. The hydraulic cylinder in accordance with claim 11, wherein:

said relief valve, said piston side chamber, said rod side chamber and said reservoir operate on hydraulic fluid;

said rod side chamber and said reservoir are arrange above said piston side chamber;

a length of said pipe extending into said reservoir controls an amount of said hydraulic fluid in said reservoir and said rod side chamber.

13. The hydraulic cylinder in accordance with claim 11, further comprising:

a hollow bore rod mounted on said bottom and extending into said piston side chamber, said hollow bore rod defining an oil passage;

a stepped portion in said hollow portion of said piston;

a cushion ring having an inner periphery fittable around an outer periphery of said hollow bore, said cushion ring mounted axially movably in said hollow portion of said piston into contact with said stepped portion for blocking communication from said oil passage to said piston side chamber through an area between said cushion ring and said piston, said cushion ring being mounted axially movably away from said stepped portion to provide communication from said oil passage to said piston side chamber through said area between said cushion ring and said piston.

* * * * *